US005199616A

United States Patent [19]

Martin

[11] Patent Number: 5,199,616

[45] Date of Patent: * Apr. 6, 1993

[54] COMBINATION DISCHARGE AND REFILL VALVE FOR UNIT DOSE DISPENSER

[76] Inventor: James H. Martin, 8322 County Line Rd., Burr Ridge, Ill. 60521

[ * ] Notice: The portion of the term of this patent subsequent to Jan. 9, 2007 has been disclaimed.

[21] Appl. No.: 867,883

[22] Filed: Apr. 13, 1992

Related U.S. Application Data

[62] Division of Ser. No. 516,529, Apr. 30, 1990, Pat. No. 5,105,995.

[51] Int. Cl.[5] ..... B65D 37/00

[52] U.S. Cl. ..... 222/402.16; 222/402.2

[58] Field of Search ..... 222/402.16, 402.2

[56] References Cited

U.S. PATENT DOCUMENTS 2,746,796 5/1956 St. Germain ..... 222/402.2 X
2,839,225 6/1958 Soffer et al. ..... 222/402.16
3,058,629 10/1962 Gawthrop ..... 222/402.16 X
3,674,185 7/1972 Evesque ..... 222/402.16
4,892,232 1/1990 Martin ..... 222/207

FOREIGN PATENT DOCUMENTS 0125865 11/1984 European Pat. Off. ..... 222/402.16

*Primary Examiner*—Kevin P. Shaver
*Attorney, Agent, or Firm*—Edmond T. Patnaude

[57] ABSTRACT

Dispensing apparatus incorporates a pressurized liquid reservoir and associated manually operable dispensing valve and a pressurized gas reservoir and associated manually operable valve respectively connecting the reservoirs to a common spray orifice. The valves are adapted to be simultaneously operated whereby a metered burst of gas from the gas reservoir breaks up a metered burst of liquid from the liquid reservoir. The liquid dispensing valve has a discharge bore through which the liquid is discharged and a check valve such that the pressurized reservoir may be refilled through the discharge bore.

3 Claims, 3 Drawing Sheets

COMBINATION DISCHARGE AND REFILL VALVE FOR UNIT DOSE DISPENSER

This is a divisional of copending application Ser. No. 07/516,529 filed on Apr. 30, 1990 and issued as U.S. Pat. No. 5,105,995 on Apr. 21, 1992.

The present invention relates in general to a dispensing device and method for use in inhalation therapy, and it relates more particularly to a new and improved device and method for providing a spray of a liquid medication.

BACKGROUND OF THE INVENTION

The dispensing device and method of the present invention are an improvement over the similar device disclosed in U.S. Pat. No. 4,976,687. When dispensing a medicinal spray for inhalation therapy it is important that the liquid droplets making up the spray have a size in the range of one to five microns. If the droplets are of a lesser size, they pass in and out of the airway of the patient without being absorbed into the tissues of the lungs. On the other hand, if the droplets are too large they collect on the walls of the throat and upper airway rather than being absorbed directly in the lung tissues. While the dispensing device of my prior application provides a precise dosage of the medication upon each actuation of the dispenser valve, the size of the droplets in the spray can vary.

My prior dispenser design requires that the reservoir be filled prior to assembly of the dispensing valve thereto. For some applications it is preferred that the reservoir be filled with the liquid medication after the dispensing valve has been assembled to the reservoir.

SUMMARY OF THE INVENTION

Briefly, in accordance with the present invention there is provided a method and device for dispensing a spray of a liquid medication or the like wherein not only is the volume and velocity of the droplets making up the spray precisely controlled but the size of the individual droplets is also maintained within a narrow predetermined range to assure the immediate and maximum absorption of the medication into the tissues of the patient to whom the spray is being administered. To this end the device and method of the present invention combines with the spray dispenser disclosed in my said application a source of pressurized gas, such as carbon dioxide, which assists in breaking up of the droplets as the spray is formed. Accordingly a separate gas dispensing valve is provided for simultaneous operation with the liquid dispensing valve when the dispenser is operated. Moreover, a predetermined volume of the gas at a predetermined pressure is emitted upon each actuation of the device.

In accordance with another aspect of the invention the liquid dispensing valve described in my said application is provided with a fill passageway and an associated check valve which facilitates filling of the reservoir which contains the liquid. In the preferred embodiment the liquid reservoir is filled directly through the outlet passageway of the main valve.

GENERAL DESCRIPTION OF THE DRAWINGS

Further objects and advantages and a better understanding of the present invention will be had by reference to the following detailed description taken in connection with the accompanying drawings wherein.

DETAILED DESCRIPTION OF A PREFERRED EMBODIMENT OF THE INVENTION

The present invention is described in connection with the dispensing of a medication in the form of a spray for administration to a patient. It will be understood, however, that the method and apparatus disclosed herein can be used to dispense other liquid materials such, for example, as saline solutions, in spray form.

Figure 1:
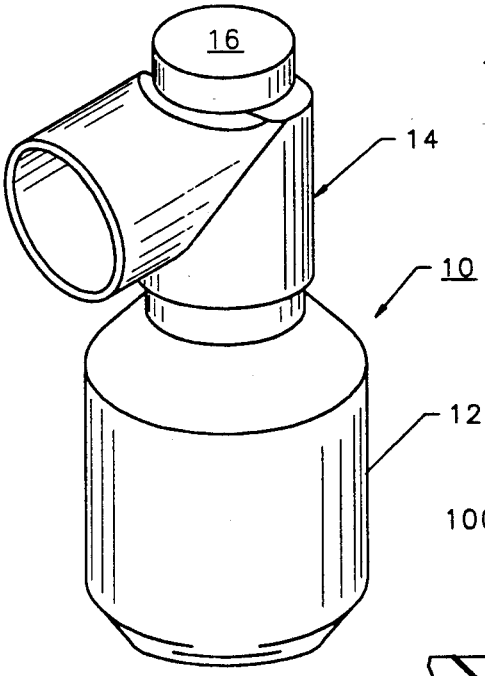
FIG. 1 is a perspective view of a medicinal dispensing device embodying the present invention.
Figure 2:
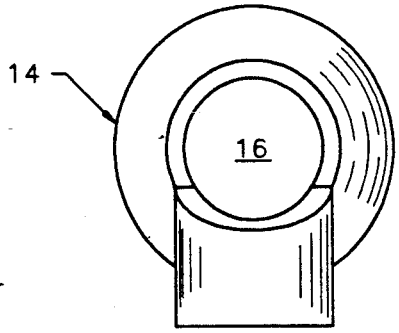
FIG. 2 is a top view of the device of FIG. 1.

Referring particularly to FIGS. 1 and 2 there is shown a unit dose liquid dispenser 10 which includes a generally cylindrical container 12 which houses a reservoir containing the liquid which is to be administered. A combined spray and actuator head 14 is mounted over the upper portion of the container 12 and includes a generally cylindrical reservoir 16 which contains a gas, such, for example, as carbon dioxide, at an elevated pressure. The gas in the reservoir must be at a sufficiently high pressure to break up the liquid into droplets of the desired size.

As described in greater detail hereinafter, fully depressing the gas reservoir 16 causes the emission of a premeasured amount of the liquid in the container 12 and a premeasured amount of the gas from the reservoir 16. The gas is directed against the liquid from the liquid reservoir as it enters a spray nozzle in the head and thus controllably breaks up the liquid droplets to provide a spray of minute liquid droplets having a size within the desired range. Upon each depression of the head 14 a burst of the spray is thereby emitted, and the burst contains a predetermined volume of the liquid at a predetermined pressure with the size of the liquid droplets in the spray being within a narrow predetermined range.

Figure 3:
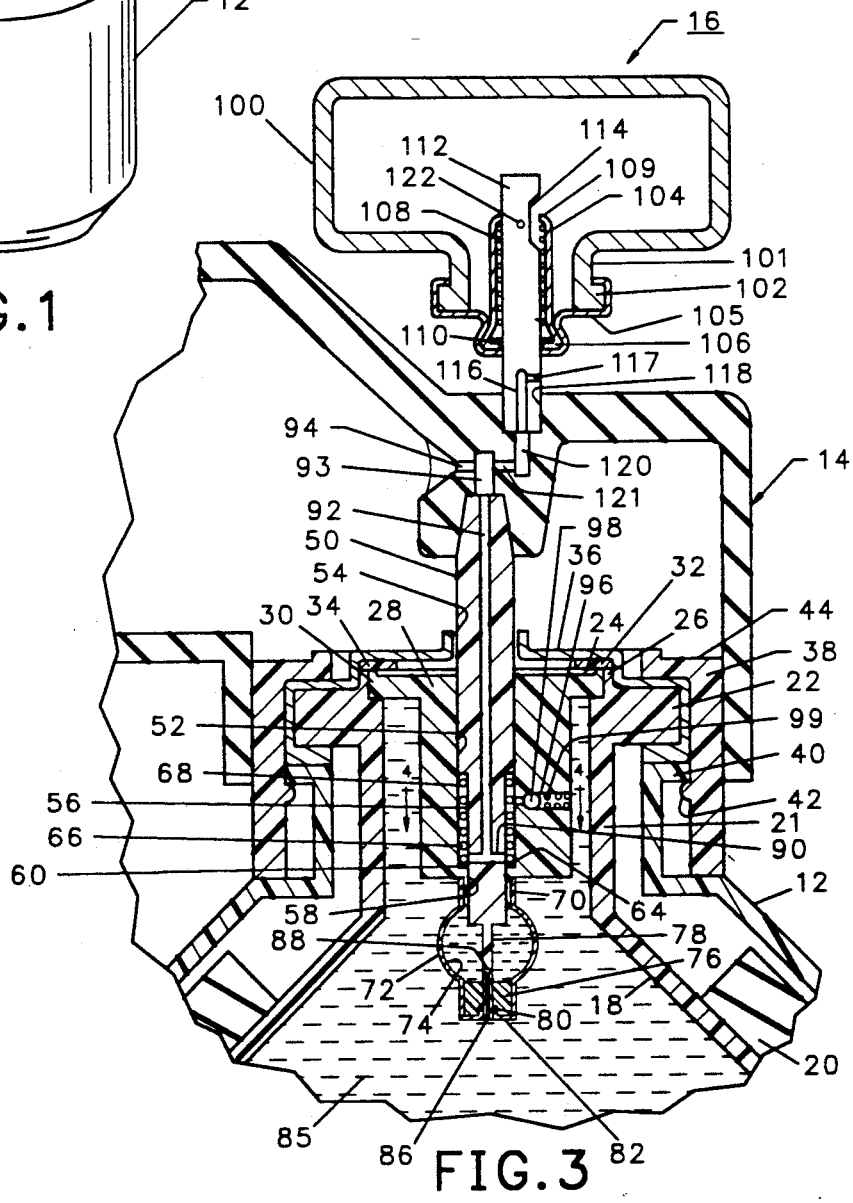
FIG. 3 is a cross-sectional view of the device of FIG. 1 taken along the vertical center line thereof, the device being shown in the inoperative or rest position.

Referring now to FIG. 3, it may be seen that the container 12 houses a main liquid reservoir which includes an expandable and collapsible inner container 18 which is enclosed by and elastomeric sleeve 20. The sleeve 20 is shown in the expanded condition wherein it exerts a substantially constant compressive force on the contents of the container 18. A pressurized reservoir of this type is described in greater detail in U.S. Pat. No. 4,387,833.

As best shown in FIG. 3, the container 18, which is preferably a blow molded plastic part, has a tubular neck portion 21 having an external annular flange 22 near the top. A counterbore 24 is provided at the top of the neck section 21 which is defined by a raised annular bead 26. A generally tubular valve housing member 28 has an external annular flange 30 at the top which seats in the counterbore 24. An annular gasket 32 is positioned over the top of the bead 26 and a raised lip 34 disposed at the outer edge of the flange 30. A locking ring 36 formed of metal compresses the gasket 32 against the top surfaces of the bead 26 and the lip 34 and holds the housing in assembled relationship to the neck of the container 16.

A locking cap 38 is snap fitted over the locking ring 36 and the upstanding neck portion of the outer housing 12. As shown, an external annular flange 40 at the top of the container 12 seats against the bottom of the ring 36, and an internal annular bead 42 on the cap 38 extends under the flange 40 while an internal annular flange portion 44 at the top seats against the top of the ring 36.

A valve stem 50 is slidably fitted in an axial bore 52 in the tubular housing member 28 and extends upwardly through a central opening 54 in the ring 36. The stem 50 has an intermediate reduced diameter section 56 which extends downwardly through a narrow bore 58 at the bottom of the housing 28. An annular gasket 60 is slidably fitted over the reduced diameter section 56 and rests on an annular shoulder 64 on the housing 28. A coil spring 66 surrounds the stem 50 and is positioned between the gasket 60 and a downwardly facing annular shoulder 68 at the junction of the large and small diameter sections of the stem 50 to urge the stem in an upward direction to the standby position shown in FIG. 3.

Fixedly secured over a tubular lower end portion 70 of the housing member 28 is an elastomeric, generally tubular metering reservoir sleeve 72 which is shown in FIG. 3 in its relieved, unstressed condition. In its unstressed condition the elastomeric sleeve 72 encloses a somewhat spherical metering chamber 74 through which the lower end portion of the stem 50 slidably and sealably extends. As may be seen in FIG. 3, the lower tubular end of the reservoir sleeve 72 is sealably bonded to a rigid tubular support sleeve 76 through which the thin, cylindrical lower end section 78 of the stem 50 slidably extends. An annular sealing gasket 80 is tightly fitted in a counterbore in the sleeve 76 and a cap 82 is bonded to the lower end of the stem 50. The cap 82 has an upwardly extending tubular section which slidably fits into the counterbore in the sleeve 76 to hold the sealing ring 80 in compression when the stem 50 is in the up position as shown in FIG. 3.

In order to permit some of the liquid 85 which fills the container 18 to fill the unit dose metering chamber 74 when the stem 50 is in the standby position shown in FIG. 3, the stem 50 is provided with an axial passageway 86 which extends from the bottom end thereof to a location where it opens onto a transverse passageway 88 which itself opens into the chamber 73 when the stem 50 is in its upward position. Because of the memory of the elastomeric reservoir sleeve 72 and the fact that there is no pressure differential across it, when the stem 50 is in the upward standby position shown in FIG. 3, the sleeve 72 returns to its unstressed state and liquid 85 flows into the metering chamber to fill it with a predetermined dose of liquid.

Figure 4:
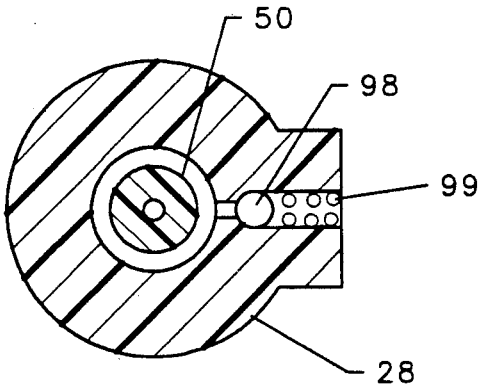
FIG. 4 is a cross-sectional view taken along the line 4—4 of FIG. 3, and particularly showing the liquid fill valve.

When the spray head 14 is depressed, the stem 50 is moved downwardly to the position shown in FIG. 4 wherein the unit dose metering chamber 74 is communicated to the ambient by interconnected passageways 90 and 92 in the stem 50. The passageway 90 extends transversely through the stem 50 and the passageway 92 extends axially from the passageway 90 to the upper end of the stem 50 where it connects via a bore 93 to a dispensing orifice 94 in the spray head 14. As the stem 50 is moved down, the passageway 88 moves out of the chamber 74 to seal the metering chamber 74 from the main reservoir chamber while the passageway 90 moves into the metering chamber 74 to communicate it to the ambient. With the metering chamber 74 open to the ambient via the passageway 90 and 92 and the orifice 94, the pressure in the main reservoir collapses the reservoir sleeve 72 to force the entire contents of the metering chamber 74 into the ambient at the pressure in the main reservoir.

The reservoir 18 maintains its contents at a substantially constant pressure as the contents are dispensed. Initially, the pressure is at a maximum, drops off to about 85 percent of the initial pressure after about 10 percent of the contents have been dispensed, and remains at the second pressure until about 90 percent of the contents have been expelled. As a consequence, the spray is emitted from the nozzle orifice 94 at a substantial constant pressure.

In order to facilitate the initial filling of the reservoir with the liquid to be administered, a transverse bore 96 is provided in the valve housing member 28. The bore 96 extends from the external surface of the member 28 to the axial bore 52 at the location of the reduced diameter section 56 when the valve stem 50 is in the up position as shown in FIG. 3. A counterbore houses a ball valve member 98 and a spring 99 which resiliently urges the ball 98 against an annular valve seat provided by the annular shoulder at the internal end of the counterbore. The housing member 28 is peened over the outer end of the spring 99 to hold it in place. During normal use of the unit 10, the ball 98 is thus held in sealing relationship with the valve seat.

In order to fill the container 18, a pressurized source of the liquid is connected to the axial passageway 92 in the valve stem which opens the ball valve and fills the container 18 through the axial passageway 92, the transverse passageway 90, the annular space housing the spring 66 and the transverse bore 96 in the valve housing member 28. This feature of the present invention thus permits filling of the container 18 after the valve has been assembled and sealed to the container 12.

The gas reservoir 16 includes a cylindrical canister 100 suitably formed of metal and having a neck portion 101 having an external annular flange 102 at the distal end thereof. A tubular housing member 104 which contains a metering chamber of predetermined volume extends through the neck 101 and is sealably connected to the canister 100 by a metal collar 105 which is roll formed over the flange 102 and the enlarged lower end 106 of the housing member 104. The upper end of the housing member 104 is necked down to provide a reentrant lip 109 and a resilient sealing gasket 110 which seals an elongate valve stem 112 to the housing 104. The valve stem 112 has a notch 114 which communicates the metering chamber in the housing 104 to the main chamber in the canister 100 when the unit is in the inoperative or rest position shown in FIG. 3. The lower end of the valve stem 112 as is shown in FIG. 3 is provided with a short axial bore 116 and a transverse bore 117 connected between the bore 116 and the external wall of the stem. The lower end of the valve stem 112 is press fitted into a counterbore 118 in the head member 14 with the bore 116 opening onto a bore 120 in the head 14. It may be seen that an extension 121 of the bore which provides the orifice 94 opens onto the bore 120.

The valve stem 112 is provided with a small, surface enlargement 122 just below the upper end of the valve housing 104 to prevent inadvertent depression of the head 14 and as more fully described hereinafter to assure that both the liquid control valve and the gas control valve will be simultaneously opened whenever the head 14 is depressed.

Figure 5:
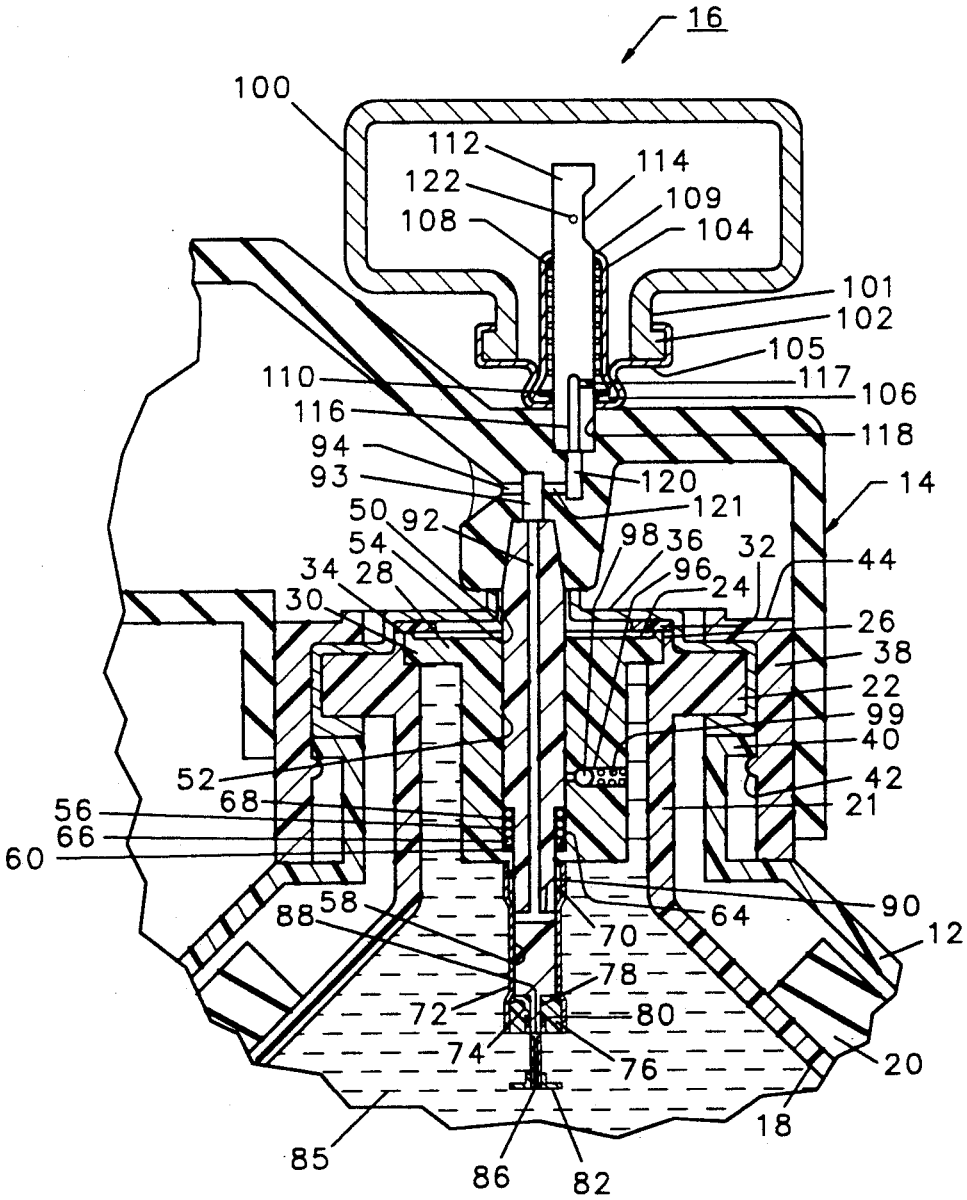
FIG. 5 is a vertical cross-sectional view similar to that of FIG. 3 but showing the device in the dispensing or operative condition.

In order to dispense a burst of the liquid from the reservoir 18, the head is pressed downwardly relative to the container 12 to the position shown in FIG. 5 by pressing down on the gas reservoir 16. The tensions of the springs 66 and 108 are selected so that when a sufficient force is applied to the reservoir 16 to cause the enlargement 122 to snap past the lip 109 at the upper end of the valve housing 104 both of the valves simultaneously open and permit the respective gas and liquid contents in the two metering chambers to flow to the orifice 94.

Figure 6:
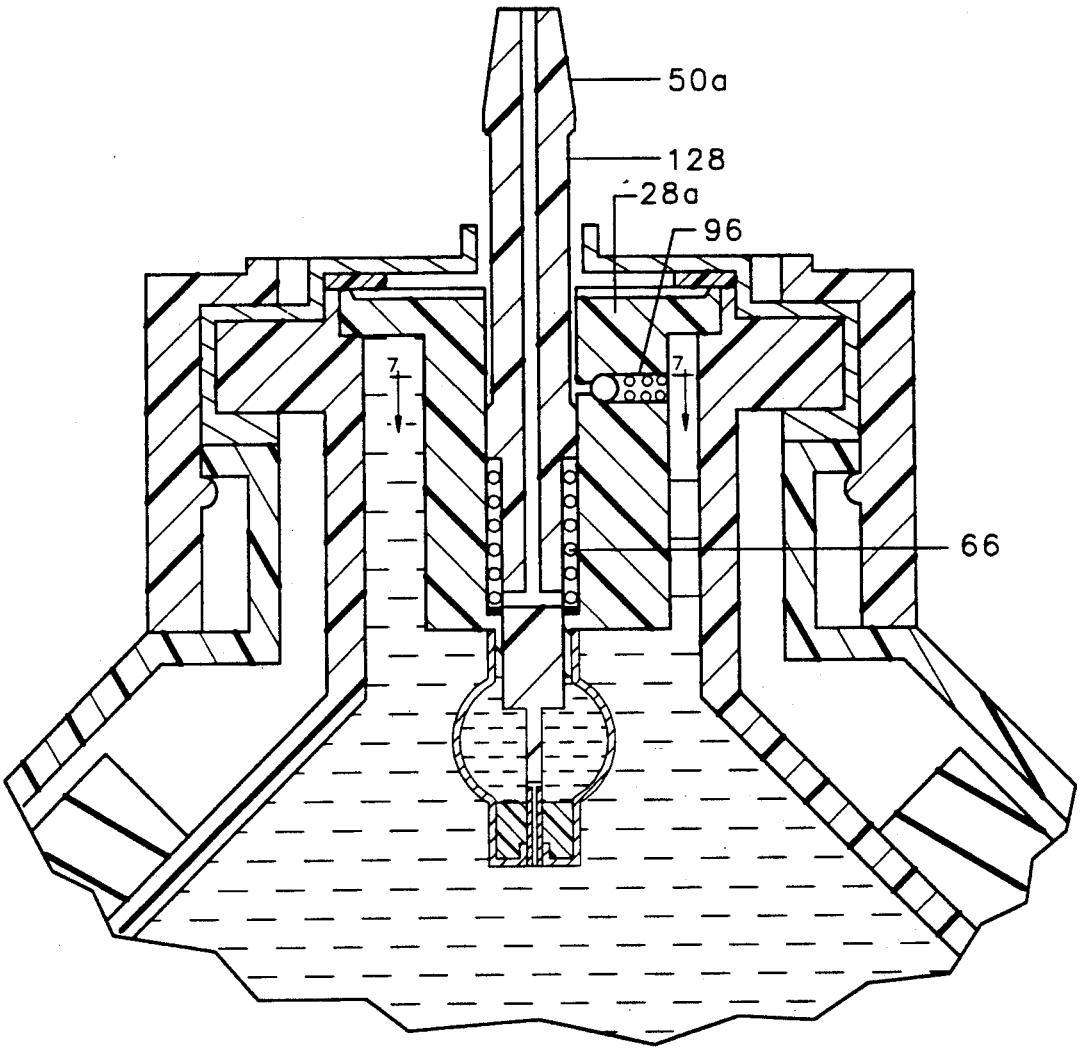
FIG. 6 is a vertical cross-sectional view of an alternative embodiment of the liquid dispensing section of the dispenser shown in FIG. 3 and FIG. 4.
Figure 7:
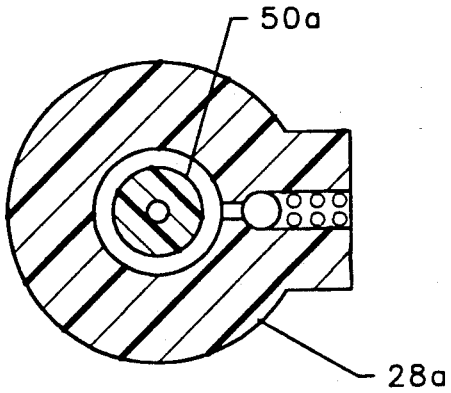
FIG. 7 is a cross-sectional view taken along the line 7—7 of FIG. 6.

Referring to FIG. 6 there is shown another embodiment of the invention which is similar to the embodiment shown in FIG. 3 and wherein like parts are identified by like reference numbers. As shown in this embodiment the liquid fill bore 96 in the valve housing member 28*a* is located above the reduced diameter portion of the stem housing the spring 66, and the valve stem 50*a* is provided with an intermediate section of reduced diameter 128 which permits a liquid under pressure to be supplied to the bore 96 when the valve stem 50*a* is in the up position.

Figure 8:
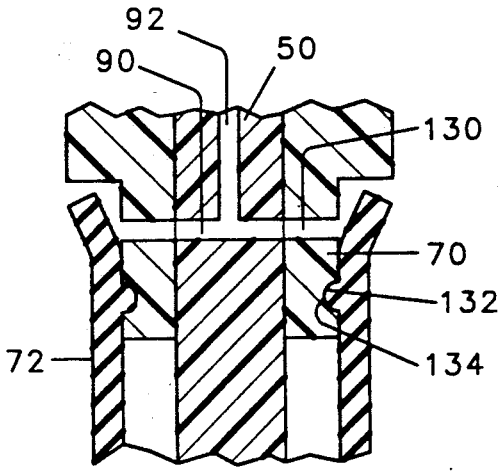
FIG. 8 is a cross-sectional view of a portion of a control valve incorporating another embodiment of the invention.

In accordance with another embodiment of the invention the transverse fill bores and associated spring loaded valves of FIGS. 3 and 6 are replaced by the resilient metering reservoir sleeve 72 itself. This embodiment is shown in FIG. 8 wherein the lower end portion 70 of the valve housing 28 is provided with a transverse passageway 130 which opens onto the external surface of the necked down portion of the valve housing member 28 just below the upper end of the resilient sleeve 72. When the valve stem is in the fill position with the transverse passageway 90 aligned with the passageway 130 and liquid is supplied under pressure to the axial passageway 92 in the valve stem 50, the upper end portion of the sleeve 72 is bowed outwardly as shown in FIG. 8 to permit the liquid to flow into the reservoir 18 to fill it. When the pressure source is removed and the passageway 90 is opened to the atmosphere, the pressure in the container 18 forces the upper portion of the sleeve 72 back into sealing engagement with the housing 28. In order to prevent the sleeve 72 from being disconnected from the housing 28 during the fill operation, an annular groove 132 is provided on the housing member 28 and a complimentary annular bead 134 is provided on the inner wall of the sleeve 72.

While the present invention has been described in connection with particular embodiments thereof, it will be understood by those skilled in the art that many changes may be made without departing from the true spirit and scope of the present invention. Therefore, it is intended by the appended claims to cover all such changes and modifications which come within the true spirit and scope of this invention.

What is claimed:

1. Dispensing apparatus, comprising in combination a first elastomeric reservoir for containing a quantity of liquid under pressure, said reservoir having an opening therein, manually operable means mounted in said reservoir across said opening for dispensing a predetermined volume of said liquid in response to each actuation thereof, said manually operable means including a second elastomeric metering reservoir having an expanded, unstressed position defining a metering chamber therein, an elongate valve stem extending coaxially through said second reservoir and movable between a first position and a second position, said valve stem having a first axial passageway extending from one end located exteriorly of said first and second reservoirs to a location remote from the other end, said passageway being sealed from said second reservoir when said valve stem is in said first position and opening into said second reservoir when said valve stem is in said second position, said valve stem having a second axial passageway extending from said other end, said other end being in communication with said first reservoir, said second passageway opening into said second reservoir when said valve stem is in said first position and being sealed from said second reservoir when said valve stem is in said second position, and check valve means connected between said first passageway and said first reservoir.

2. Dispensing apparatus according to claim 1, wherein said check valve means comprises a third passageway connected between said first passageway and said first reservoir, and said check valve being connected in said third passageway to permit the flow of liquid from said first passageway to said first reservoir.

3. Dispensing apparatus, comprising in combination a first elastomeric reservoir for containing a quantity of liquid under pressure, said reservoir having an opening therein, manually operable means mounted in said reservoir across said opening for dispensing a predetermined volume of said liquid in response to each actuation thereof, said manually operable means including a second elastomeric metering reservoir having an expanded, unstressed position defining a metering chamber therein, an elongate valve stem extending coaxially through said second reservoir and movable between a first position and a second position, said valve stem having a first axial passageway extending from one end located exteriorly of said first and second reservoirs to a location remote from the other end, said passageway being sealed from said second reservoir when said valve stem is in said first position and opening into said second reservoir when said valve stem is in said second position, said valve stem having a second axial passageway extending from said other end, said other end being in communication with said first reservoir, said second passageway opening into said second reservoir when said valve stem is in said first position and being sealed from said second reservoir when said valve stem is in said second position, and check valve means connected between said first reservoir and the ambient for filling said first reservoir with said liquid.

* * * * *